US005460384A

United States Patent [19]

Seidel et al.

[11] Patent Number: 5,460,384

[45] Date of Patent: Oct. 24, 1995

[54] COIN JUMP TARGET GAME

[75] Inventors: Edward J. Seidel, Albuquerque; Charles J. Ohler, Tijeras, both of N.M.

[73] Assignee: Seidel Amusement Machine Co., Inc., Albuquerque, N.M.

[21] Appl. No.: 383,252

[22] Filed: Feb. 3, 1995

[51] Int. Cl.[6] ..... A63F 9/00

[52] U.S. Cl. ..... 273/402; 273/348

[58] Field of Search ..... 273/348, 354, 273/355, 356, 398, 399, 402

[56] References Cited

U.S. PATENT DOCUMENTS

| | | | |
|---|---|---|---|
| 1,115,642 | 11/1914 | Wood | 273/120 |
| 1,918,094 | 7/1933 | Geekas | 273/354 |
| 2,534,730 | 12/1950 | Peacock | 273/387 |
| 3,649,019 | 3/1972 | Barlow | 273/354 X |
| 4,240,536 | 12/1980 | Noell, Jr. | 273/355 |
| 4,303,248 | 12/1981 | Shoemaker, Jr. et al. | 273/356 |
| 5,071,127 | 12/1991 | Bromley et al. | 273/85 A |
| 5,121,919 | 6/1992 | Martti | 273/121 B |
| 5,292,127 | 3/1994 | Kelly et al. | 273/138 R |
| 5,385,347 | 1/1995 | Halliburton | 273/142 R |

*Primary Examiner*—William H. Grieb
*Attorney, Agent, or Firm*—Robert W. Harris

[57] ABSTRACT

A coordination-skill-oriented, action target game machine, affording opportunities to score points by successfully timing insertion of a coin or other token into the machine, by timing the token insertion in relation to the motion of a rotating aperture wheel having apertures which the token must traverse to reach a target aperture behind the aperture wheel, in order to score points for a corresponding award by a ticket dispenser mechanism. After insertion into a fixed accepting mechanism, the token rolls down an inclined ramp of the general form of a ski jump, acquiring sufficient momentum to jump to the aperture wheel, where it either passes through an aperture to reach the target aperture and score points for the player, or is blocked by the aperture wheel, if it misses any aperture of the wheel. The apertures of the aperture wheel are slots having varying widths, and the scoring is higher for plays which traverse the narrower apertures.

10 Claims, 3 Drawing Sheets

COIN JUMP TARGET GAME

BACKGROUND OF THE INVENTION

The present invention concerns machines for playing games initiated by inserting coins or other tokens, in which a player seeks to win points, which points may result in an award reflected in tickets or coupons issued by the machine. More particularly the invention concerns such a machine in which the player's skill in timing the motion of the inserted coin or other token itself determines the points scored by the player.

There are many coin operated game devices which involve varying degrees of skill and chance in determining the outcome of the game. In some such devices chance plays a major role in deciding game outcome. And some such devices involve quite complex mechanisms or complex software, to control operation of the game.

Applicant's invention is responsive to a need for a relatively simple, but challenging and entertaining, action coin game device which affords a player an opportunity to win points on the basis of exercising coordination skill, and in which chance is removed as a factor in determining game outcome, and which provides a game which is easy for a player to understand and play, for all ages, while at the same time allowing exercise of a high degree of skill.

The approach of the preferred embodiment of applicant's invention, to meeting said need, is one of combining a ramp to give significant velocity to the inserted token, via motion of the token under gravity, resulting in a jump of the token from the end of the ramp, and a moving wheel with apertures which must be traversed by the jumping token to win points, said wheel challenging the player's coordination skill.

The purpose of the invention is the provision of a relatively simple, easily operated, action-oriented game, to allow a player to exercise timing coordination skills, with chance removed as a determining factor.

SUMMARY OF THE INVENTION

The invention is a coordination-skill-oriented, action target game machine, which affords the player opportunities to score points by successfully timing insertion of a coin, token or other object, e.g. a ball (hereafter generally termed "token" for any of the above) into the machine, timing the token insertion with reference to the motion of a rotating aperture wheel having apertures which the token must traverse to reach a target aperture behind the aperture wheel, in order to score points for a corresponding award by a ticket dispenser mechanism. After insertion into a fixed accepting mechanism, the token rolls down an inclined ramp of the general form of a ski jump, thus acquiring sufficient momentum to jump from the lower end of the ramp to the aperture wheel, where it either passes through an aperture to reach the target aperture, scoring points for the player, or is blocked by the aperture wheel, if it misses any aperture in that wheel. The apertures of the aperture wheel are slots having varying widths, and the scoring is higher for plays which traverse the narrower apertures. In the preferred embodiment, the apparatus is configured such that the token reaches the aperture wheel below its center, where the slots are oriented vertically. For the version of the invention using coins, in the preferred embodiment the ramp is configured to keep the coin upright as it rolls down the ramp, so as to maximize the chance of traversing a vertically oriented slot in the aperture wheel. To prevent undue discouragement of a player from multiple misses, the scoring system has a multiplier feature, so that after every two consecutive misses, the multiplier amount for the next score is increased by one. Upon successful traversing of the aperture wheel, the scoring points of the aperture are multiplied by the multiplier amount. The preferred embodiment has an aperture wheel in which the four narrowest slots are bonus slots, which have the highest point scores, and also trigger a bonus feature, when traversed for a score: When a player scores through a bonus slot, not only does he/she get the points corresponding to the bonus slot, multiplied by any multiplier in effect, but also this triggers the running of countdown timer, determining a time period in which any scoring through any of the bonus slots also gives bonus points, in a programmable amount.

DESCRIPTION OF THE PREFERRED EMBODIMENT

Figure 1:
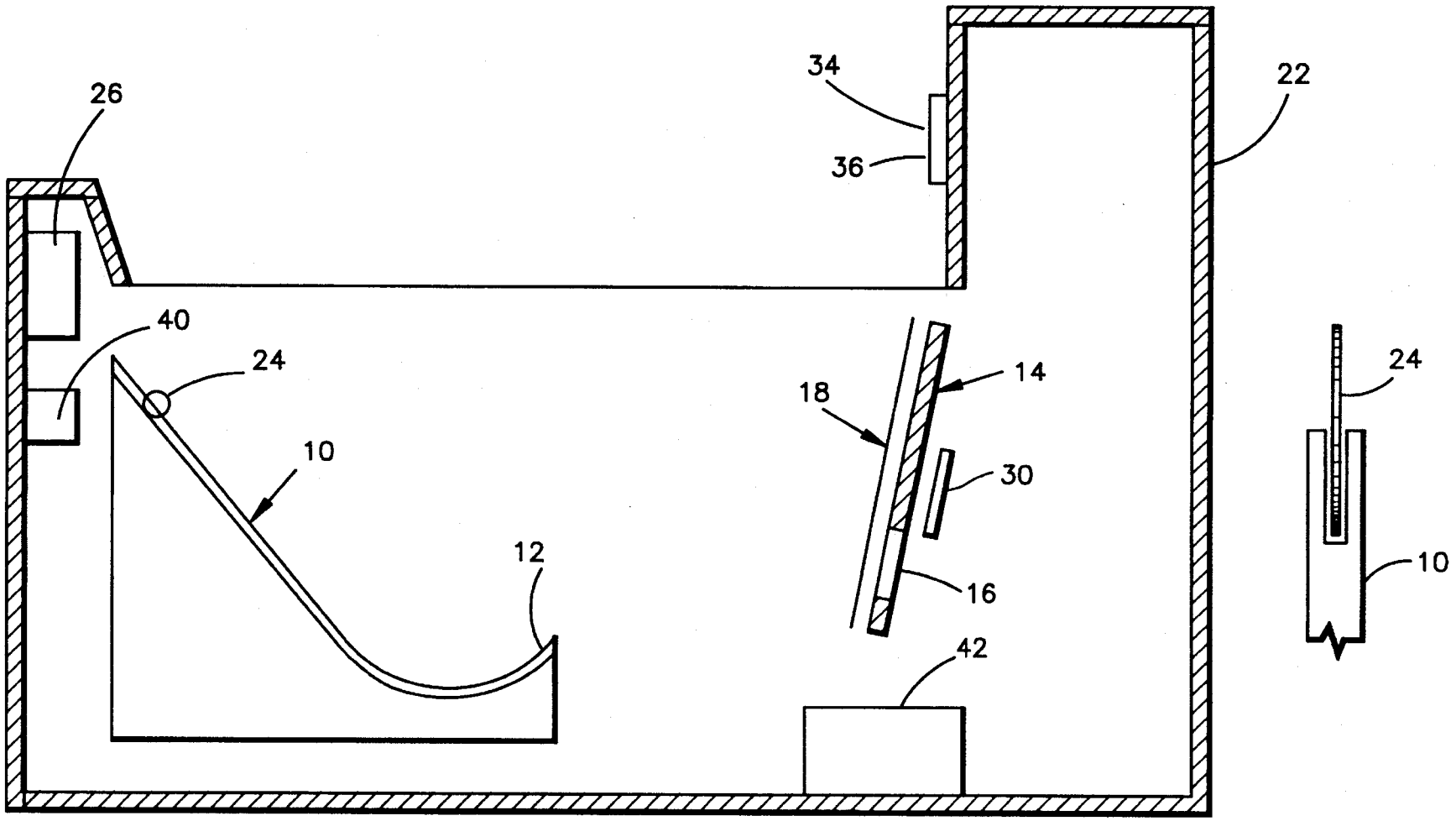
FIG. 1 is a side elevational view of the invention, partially in section, also showing a cross section of the ramp.

Referring now to the drawings, in which like reference numbers denote like or corresponding elements, the principal components of the machine are an inclined ramp 10, having in its lower portion a configuration of the general form of a ski jump, terminating at end 12; a fixed target 14 in front of ramp 10, having a target aperture 16; and an aperture wheel 18, having a plurality of apertures 20, located between ramp 10 and target 14. All of these and other components of the machine, discussed below, are housed in a cabinet 22.

The player inserts a token 24 into a fixed accepting mechanism 26, a standard coin accepting mechanism commonly used in the industry, from whence token 24 rolls down ramp 10, accelerating under gravity, so that token 24 becomes airborne when it leaves end 12 of ramp 10. The height and slope of ramp 10, and the relative placement of ramp 10 and target 14, and particularly aperture 16, are chosen such that the airborne path of token 24 will pass through aperture 16 of target 14, if token 24 is not obstructed in its flight toward target 14. Thus, absent any such obstruction, each and every token 24 inserted into accepting mechanism 26 by the player, would pass through aperture 16 of target 14.

However, in order to reach target 14, and its aperture 16, the token 24 must pass through one of the apertures 20 of aperture wheel 18, since aperture wheel 18 lies across the airborne path of token 24, on its way from end 12 of ramp 10, to target 14.

Figure 2:
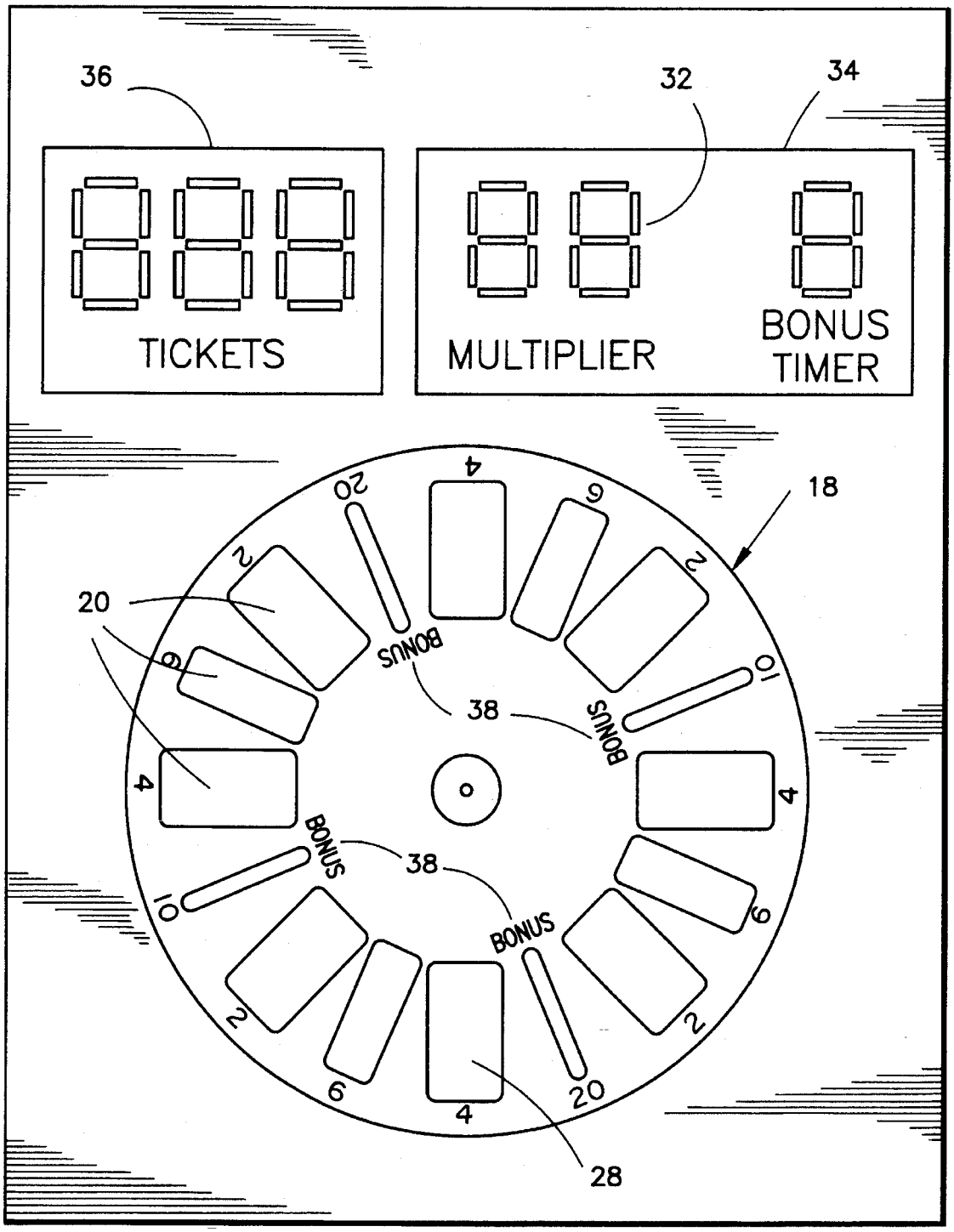
FIG. 2 is a view of the aperture wheel and scoring display features.

As indicated in FIG. 2, the apertures 20 are of varying width, and are assigned scores which are higher for the narrower widths. Scoring is controlled by the operational control means, as detailed below. The aperture wheel 18 is rotated at a constant rather slow rate of rotation, 12 RPM, so that the player has an opportunity, by observing the rotation rate, and observing the time required for an inserted token 24 to reach aperture wheel 18, to time his/her insertion of token 24 into accepting mechanism 26, so that the token 24 will reach aperture wheel 18 just when a desired one of the apertures 20 is in position to pass the token 24 through aperture wheel 18. As indicated in FIGS. 1 and 2, the position of aperture wheel 18 is such that when the airborne path of a token 24 passes through one of the apertures 20, e.g. aperture 28 in FIG. 3, it does so when aperture 28 is located directly below the center of aperture wheel 18, and is vertically oriented. As indicated in FIG. 1, for the version of the game in which the token 24 is a coin or other round flat token 24, the ramp 10 has a U-shaped cross section of suitable dimensions so as to keep the token 24 upright as it rolls down ramp 10 and flies toward aperture wheel 18, to maximize the chance of passing through one of the apertures 20, e.g. aperture 28, as compared to the lower chance of passage that would exist if token 24 were not vertically oriented.

The ramp 10 constitutes the particular acceleration means, for the preferred embodiment, for accelerating the tokens 24 to a sufficient velocity, in a reproducible manner, to make them become airborne and fly toward the aperture wheel 18 and the aperture 16 of target 14, in such fashion that each token 24 will enter aperture 16 if not blocked by aperture wheel 18.

The aperture wheel 18, together with a wheel motor 30 which rotates aperture wheel 18, constitute the particular moving aperture means, for the preferred embodiment, for moving a plurality of apertures of varying fixed widths, in the space between ramp 10 and aperture 16 of target 14, and for moving said apertures across the path of flight of the tokens 24 from ramp 10 to aperture 16 of target 14, in a continuous, reproducible fashion visible to the player, so as to alternately allow passage of the token 24 through said moving aperture means, when one of said apertures lies on said path of flight, and block passage of the token 24 when none of said apertures lies on said path of flight.

Since both the acceleration means and the moving aperture means function in a reproducible manner, and since the motion of the moving aperture means is visible to the player, the player is afforded the opportunity to use his/her coordination skills to successfully time insertion of the token 24, so as to cause token 24 to pass through any desired one of the apertures 20 in aperture wheel 18.

The game has a score multiplying feature, as an inducement to continued effort by players who initially score poorly. Each time the player fails to score twice in succession, by missing any of the apertures 20 of aperture wheel 18, a multiplier value 32, visible to the player in display 34, is increased by 1. The next time the player succeeds in passing a token 24 through one of the apertures 20 to reach aperture 16, the point value of the particular one of the apertures 20 traversed by token 24, is multiplied by the multiplier value 32, before being added to the player's score, which score is the ticket amount shown in a display 36 which is also visible to the player. Once this has occurred, the multiplier amount is reset to 1.

The four narrowest of the apertures 20 in aperture wheel 18, are bonus slots 38, which have the highest point scores, and also offer the player an opportunity to take advantage of an additional, bonus feature. When the player scores through one of the bonus slots 38, two things happen. First, the point value assigned to the bonus slot, multiplied by any multiplier value 32 then in effect, is added to the players score shown in display 36. Second, a countdown timer is initiated, which shows a remaining bonus time interval which decreases at a programmable rate, and which interval is displayed in display 34. If the player is able to score through any of the bonus slots 38 before the bonus time interval reaches zero, a bonus value is added to the player's regular point score for that play (the aperture amount times any multiplier value 32 in effect at the time), to determine the ticket amount shown in display 36. The multiplier value 32 does not apply to the bonus amount, in this event. If the player is unable to score through a bonus slot during the bonus time interval, the bonus timer portion of display 34 goes blank, indicating that the bonus scoring opportunity is no longer available.

Tickets reflecting accumulated player points shown in display 36, are dispensed to the player by a ticket dispenser mechanism 40. Tickets are dispensed immediately upon scoring, with the ticket amount shown in display 36 decreasing by one as each ticket is dispensed. The ticket dispenser mechanism 40 is capable of dispensing tickets at a rate of 13 tickets per minute, but a good player can accumulate points at a much higher rate, and points for undistributed tickets will remain displayed in display 36 until the ticket dispenser mechanism 40 catches up.

The tokens 24, whether or not the player scores in a given play, fall into a token collection box 42 located below target 14 and aperture wheel 18, on the floor of cabinet 22.

Figure 3:
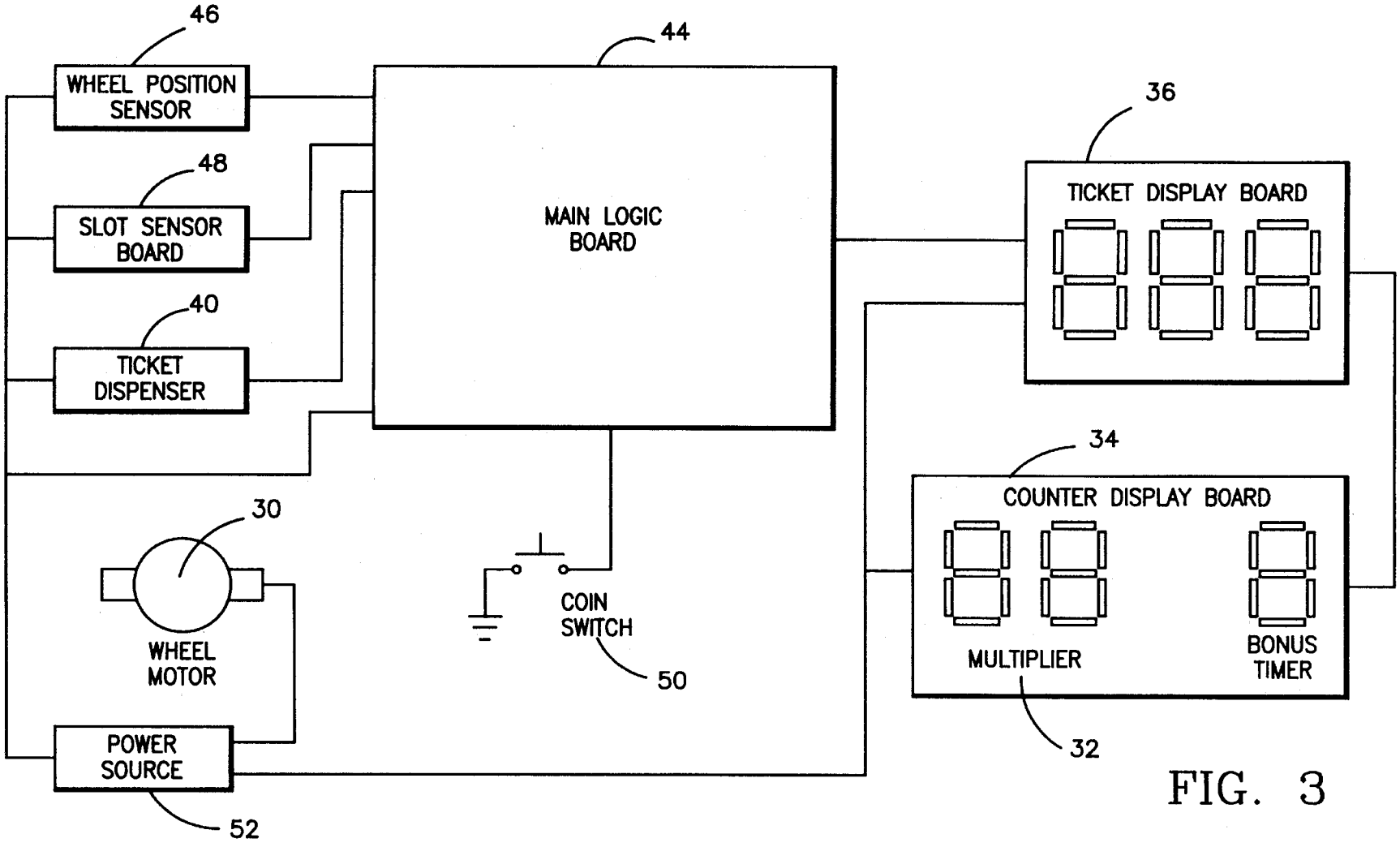
FIG. 3 is a schematic of the electrical control system.

The particular operation control means for controlling scoring and ticket awards with the game, used with the preferred embodiment, is illustrated in FIG. 3. This operation control means comprises: a main logic board 44, a wheel position sensor 46, a slot sensor board 48, the ticket display board 36, the display 34 showing any multiplier value 32 in effect and any unexpired bonus interval, the ticket dispenser mechanism 40, and the token switch 50.

The main logic board 44 provides all the control functions needed for game operation. The microcontroller used is a 68HC705, which contains 192 bytes of RAM, 8192 bytes of ROM, three eight bit general purpose I/O ports, and two types of serial I/O. The RS-232 serial port is not used in this configuration. Game sounds are stored in a separate ROM in compressed digital format. The audio DSP, after being instructed by the microcontroller which sound to play, reads data from ROM, decompressed it, and converts it into analog signal which is filtered and amplified, so as to produce any desired audible game sounds.

The wheel position sensor board 46 reads a binary pattern which is attached to the back of the aperture wheel 18, in order to determine the point value of the particular one of the apertures 20 which is in front of the aperture 16 of target 14 at any given moment. The wheel position sensor board 46 has 5 reflective sensors which can detect the dots of the binary pattern, each of which sensors contains both an IR source and detector. Output from these sensors is buffered and amplified before being sent to the main logic board 44.

The slot sensor board 48 detects passage of a token 24 through one of the apertures 20 of aperture wheel 18, by detecting its passage through aperture 16 of target 14. 7 LED light sources and photo-transistors provide a light curtain with sufficient resolution to detect any sized token 24 that may be used in the game. The slot sensor board 48 and its light curtain are located on the back side of the aperture 16 of target 14, so that the token 24 first passes through one of the apertures 20 of aperture wheel 18, and then through aperture 16 and finally through the slot sensor board 48 and its light curtain. Output from the photo-transistors is buffered, amplified and then combined to provide a single signal to the main logic board 44, indicating that a token 24 has passed through one of the apertures 20 of aperture wheel 18.

The token switch 50, which is located at the output of accepting mechanism 26, initiates operation of the main logic board 44, when the player inserts a token 24 into the machine.

The ticket display board 36 shows the amount of the tickets won by the player. Data for the display of the ticket amount on display 36 is received in serial format from the main logic board 44. A serial to parallel conversion is performed on the data which is then latched into sink drivers so the LED digits reflect the data received. The boards of the display 36 and display 34 each contain the serial to parallel/sink driver chips.

The counter display 34 shows value of the miss multiplier, which is in effect after each two consecutive misses, and also shows any remaining bonus time interval which may be in effect. Operation is identical to that of the display 36.

The ticket dispenser mechanism 40 is a commercially available electro-mechanical device which dispenses tickets to the player. The dispenser motor is caused to run by a signal from the main logic board 44. A slotted optical sensor (not shown) detects a notch in each ticket dispensed. The output from this sensor is buffered and sent to the main logic board 44 so that the correct amount of tickets are issued to the player.

Also shown in FIG. 3 is the wheel motor 30, which rotates the aperture wheel 18, at a constant rate of 12 RPM. A suitable power source 52, which is not part of the invention, powers both the wheel motor 30 and the other electronic components, as indicated in FIG. 3.

Operation of the operation control means is initiated when the main logic board 44 detects that a token 24 has passed by the token switch 50, at the output of accepting mechanism 26. The token 24 then rolls down ramp 10, becoming airborne when it leaves end 12 of ramp 10, and moves toward aperture 16 of target 14. The output of the slot sensor board 48 is monitored by the main logic board 44 for the time interval required for the token 24 to reach aperture 16, after passing token switch 50, (hereinafter "token transit time"). If the token transit time expires without receipt by the main logic board 44 of a signal from the slot sensor board 48 indicating traversal of one of the apertures 20 by token 24, this token play is determined to have been a miss. If the player receives consecutive misses, which may be programmed in the main logic board 44 for either 1, 2, 3 or 4 consecutive misses, then the multiplier value 32, displayed in display 34, is increased by one, by the main logic board 44.

If the main logic board 44 does receive a signal from the slot sensor board 48 before expiration of the token transit time, thus indicating that the token 24 has passed through one of the apertures 20, the main logic board 44 immediately determines the point value of the particular aperture 28 which the token 24 passed through, by reading the output of the wheel position sensor board 46. The number of ticket units to dispense, from the ticket dispenser mechanism 40, for that successful score, is determined by the main logic board 44, as being the point value assigned to the particular aperture 28 traversed by the token 24, multiplied by any multiplier value 32 then in effect. That product is then added to any ticket amount not yet dispensed, shown in display 36. Whenever a multiplier value 32 is thus used, the multiplier value 32 is then reset to 1 by the main logic board 44. The main logic board 44 dispenses the tickets to the player, via ticket dispenser mechanism 40, and causes the ticket amount, displayed in display 36, to decrement by 1 for each ticket dispensed.

When the player scores through one of the bonus slots 38, the main logic board 44 sets the bonus time interval, displayed in display 34, at an initial value of 9, and reduces the displayed remaining bonus time interval at a programmable rate, which may be set at either ½ sec., ¾ sec., or 1 sec., for each decrease of one unit in the remaining bonus time interval. If the player makes another score through any of the bonus slots 38 during the bonus time interval, the main logic board 44 is programmed to award the player a bonus award of tickets, which may be one of four values, i.e. 25, 50, 100 or 150 tickets. The multiplier value 32 is not applied to the ticket award in this event.

Those familiar with the art will appreciate that the invention may be employed in configurations other than the specific forms disclosed herein, without departing from the essential substance thereof.

For example, and not by way of limitation, the acceleration means of the invention need not necessarily be of the same ski jump configuration as used in the preferred embodiment. A different shaped ramp could instead by used, e.g. one not having the raised ski jump feature on the end of the ramp. Or a non-gravity powered acceleration means might be used, instead of a ramp, such as a cocked spring powered device. The only requirement is that the acceleration means function in a reproducible manner, so as to afford the player the opportunity to score well by exercise of superior coordination skill.

Similarly, the moving aperture means of the invention need not necessarily involve a rotating wheel. For example, the moving aperture means could instead be formed by a rectangular flat screen, disposed across the path of flight of the token 24 between ramp 10 and aperture 16, having a plurality of parallel slit shaped apertures of varying widths, together with a translational motor mechanism to move said screen back and forth in a direction perpendicular to the direction of said apertures, in a reproducible manner, which would periodically allow passage of the token 24 through the screen in a reproducible manner. As in the case of the acceleration means, the only requirement would be that the motion of the moving aperture means be reproducible, so as to afford the player the opportunity to score well by exercise of superior coordination skill.

Although the preferred embodiment is designed for use with coins as tokens, appropriately modified forms of the invention could be used with other objects as the tokens, such as balls, pucks or other projectiles capable of rolling or sliding down a ramp and being propelled toward an aperture wheel.

Similarly it would be possible to configure the game with switches to allow the operator to vary parameters of the game to suit individual operator wishes, e.g..varying the aperture values assigned to the various apertures 20 of aperture wheel 18; varying the number of misses needed to activate the multiplier feature; varying the duration of the countdown period for the bonus feature; varying the bonus amount; and a variation such that the game would issue either one, two, or three tickets for each miss.

The scope of the invention is defined by the following claims, including also all subject matter encompassed by the doctrine of equivalents as applicable to the claims.

I claim:

1. Game apparatus, for use in a game machine accepting tokens through a token accepting means, for the type of game machine in which a player seeks to cause said token to reach a target within said machine, said target having a target aperture, said game apparatus comprising:

(a) acceleration means, communicating with said token accepting means, for receiving said tokens from said token accepting means, and for accelerating said tokens to a sufficient velocity, in a reproducible manner, to make them become airborne and fly toward said target aperture over a path of flight, in such fashion that each token will enter said target aperture if not blocked by any obstruction in said path of flight;

(b) moving aperture means, disposed across said path of flight between said acceleration means and said target aperture, for moving a plurality of apertures of varying fixed widths across said path of flight of said tokens in a continuous, reproducible fashion visible to said player, so as to alternately allow passage of said tokens through said moving aperture means, when one of said apertures lies on said path of flight, and block passage of said tokens when none of said apertures lies on said path of flight; and (c) operation control means, responsive to said motion of said tokens, for determining when one of said tokens traverses one of said apertures of said moving aperture means, and for determining which of said apertures of said moving aperture means is traversed by said token, and for controlling the awarding of points to said player in a manner such that more points may be awarded, the narrower the one of said apertures of said moving aperture means which is traversed by said token.

2. The game apparatus of claim 1, wherein said acceleration means is a means to accelerate said tokens by the action of gravity.

3. The game apparatus of claim 2, wherein said acceleration means is a ramp.

4. The game apparatus of claim 3, wherein said ramp has a configuration of the general form of a ski jump.

5. The game apparatus of claim 1, wherein said moving aperture means comprises a wheel, having a plurality of radially directed apertures of varying fixed widths; and rotation means, connected to said wheel, for rotating said wheel at an at least substantially constant rate of rotation.

6. The game apparatus of claim 1, wherein said moving aperture means comprises a rectangular screen, having a plurality of parallel slit shaped apertures of varying fixed widths; and translational means, connected to said screen, for moving said screen back and forth in a direction at least substantially perpendicular to said parallel apertures, in a reproducible manner.

7. The game apparatus of claim 1, wherein said operation control means further comprises means to determine when said player has failed in a specified number of consecutive attempts to reach said target aperture with said token, and in that event to increase a miss multiplier amount by 1, and to multiply the points awarded to each player, each time one of said tokens traverses one of said apertures of said moving aperture means, by the amount of said miss multiplier amount then in effect, and to reset said miss multiplier amount to 1 immediately after any points awarded have been based upon a value of said miss multiplier in excess of 1.

8. The game apparatus of claim 1, wherein said operation control means further comprises means to determine whether said player has scored by causing said token to traverse any of certain bonus apertures of said moving aperture means, and for initiating, immediately upon traversal of one of said bonus apertures by said token, the running of a bonus time interval, and for awarding bonus points to said player if said player causes another token to traverse any of said bonus slots during said bonus time interval.

9. The game apparatus of claim 1, wherein said operation control means further comprises means to dispense tickets to said player, in an amount corresponding to said points awarded to said player.

10. The game apparatus of claim 1, wherein said operation control means is a means such that more points are always awarded, the narrower the one of said apertures of said moving aperture means which is traversed by said token.

* * * * *